US007997165B2

(12) United States Patent
Holladay et al.

(10) Patent No.: US 7,997,165 B2
(45) **Date of Patent: *Aug. 16, 2011**

(54) SUCKER ROD COUPLING EXTRACTOR

(75) Inventors: Montie W. Holladay, College Station, TX (US); David W. Ripple, Bryan, TX (US)

(73) Assignee: Montie W. Holladay, College Station, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/947,569

(22) Filed: Nov. 16, 2010

(65) Prior Publication Data

US 2011/0094345 A1 Apr. 28, 2011

Related U.S. Application Data

(63) Continuation of application No. 12/011,071, filed on Jan. 24, 2008, now Pat. No. 7,856,908.

(60) Provisional application No. 60/899,108, filed on Feb. 2, 2007.

(51) Int. Cl.
*B25B 21/00* (2006.01)
*B25B 23/00* (2006.01)

(52) U.S. Cl. ..... 81/57.16; 81/57.24; 81/57.34; 81/53.2; 81/441

(58) Field of Classification Search ..... 81/57.15–57.21, 81/57.24, 57.32–56.36, 53.2, 441; 166/77.51, 166/85.1, 377; 173/164
See application file for complete search history.

(56) References Cited

U.S. PATENT DOCUMENTS

| | | | | |
|---|---|---|---|---|
| 2,944,453 | A | 7/1960 | Brewington | |
| 3,144,794 | A * | 8/1964 | Foster | 81/56 |
| 3,471,160 | A | 10/1969 | Sabo | |
| 4,494,425 | A | 1/1985 | Shewmake, Sr. | |
| 4,604,917 | A * | 8/1986 | Polonsky | 81/53.2 |
| 4,688,315 | A * | 8/1987 | Jannke | 29/426.4 |
| 4,932,292 | A * | 6/1990 | Merrick | 81/57.18 |
| 5,010,635 | A * | 4/1991 | Clark | 29/426.5 |
| 5,251,516 | A | 10/1993 | Desaulniers | |
| 5,361,831 | A * | 11/1994 | Young | 166/77.51 |

(Continued)

OTHER PUBLICATIONS

PCT International Search Report and Written Opinion for International Application No. PCT/US08/08877, which corresponds to the parent application of the present application.

*Primary Examiner* — Debra S Meislin
(74) *Attorney, Agent, or Firm* — Stephen S. Hodgson

(57) ABSTRACT

A prior art sucker rod tong is improved to remove a coupling completely from a sucker rod assembly comprising sucker rods joined end to end by couplings. The prior art sucker rod tong has a rotatable jaw assembly and a lower backup wrench adapted to cooperate to unscrew a coupling joining first and second rods, where the coupling remains screwed to the second rod after it is unscrewed from the first rod. The improvement comprises a coupling extractor for unscrewing the coupling from the second rod so that the coupling can be replaced. The coupling extractor comprises a shaft having an extractor end portion on each end of the shaft and a shield around each extractor end portion, wherein the coupling extractor is designed and sized to fit within and to be rotated by the jaw assembly. The extractor end portion engages the inside wall of the coupling to unscrew the coupling from the second rod. The extractor end portion is preferably a tapered, left-handed spiral fluted easy-out extractor. The improvement preferably further comprises an upper backup wrench movably connected to the sucker rod tong for holding the second sucker rod when the second sucker rod is above the coupling.

26 Claims, 7 Drawing Sheets

U.S. PATENT DOCUMENTS 5,388,647 A * 2/1995 McGlothlin ..... 166/301
5,433,128 A * 7/1995 Wacker ..... 81/57.34
5,906,146 A * 5/1999 Arlen ..... 81/53.2
6,330,911 B1 12/2001 Allen et al.
6,374,706 B1 * 4/2002 Newman ..... 81/57.34
6,634,259 B2 10/2003 Castille
6,829,968 B2 12/2004 Hauk et al.
6,942,254 B2 * 9/2005 Cartsensen ..... 285/123.1

* cited by examiner 20
62
18
16j
62f
62d
64a
62e
64
62b
62g
16g
60
64b
16e
16f
16c
50h
50m
50b
50f
50d
50a
24c
22a
24b
24a
34
16d
24c
32a
50c
C
50g
50e
28a
F2
50i
28
SR2

SUCKER ROD COUPLING EXTRACTOR

CROSS REFERENCE TO RELATED APPLICATION

This a continuation of and priority is claimed to U.S. patent application Ser. No. 12/011,071, filed Jan. 24, 2008, and issued as U.S. Pat. No. 7,856,908 on Dec. 28, 2010, which is hereby incorporated by reference and which claims priority to U.S. Provisional Patent Application Ser. No. 60/899,108, filed on Feb. 2, 2007, which is hereby incorporated by reference.

BACKGROUND OF THE INVENTION

1. Field of the Invention

This present invention relates to production equipment for oil wells and more particularly to removing a coupling from a sucker rod.

2. Description of the Related Art

Wells are drilled into the earth for extraction of oil. After a well is drilled, a metal casing is cemented into the wellbore to keep the hole from collapsing. The casing is punctured at the depth of the producing formation so that oil can flow into the casing. While oil from some wells flows to the surface due to high pressure in the earth, oil from some other wells must be pumped to the surface. In wells where oil flows under its own pressure, after the casing is cemented and perforated, a production tubing string is lowered to the perforation depth, a packer is set, and oil flows through the production tubing string. In the case where oil does not flow under its own pressure, the production tubing string is lowered to a predetermined depth and secured by a tubing anchor. A well head secures the top of the production tubing string. A pump is attached to a sucker rod and lowered into the well by attaching one sucker rod after another using a coupling for each connection. A series of sucker rods connects the pump to surface equipment that moves the entire length of sucker rods up and down to provide a reciprocating motion for the pump, which pumps oil up through the production tubing string around the sucker rods.

Each sucker rod is typically a cylindrical bar of metal that has male threads on each end. The length of the rods ranges between about 25 and about 30 feet, and the diameter is typically ½, ¾, ⅞, ⅞ EL, 1 or 1 and ⅛ inches. The rods are connected end to end by a coupling, which is often referred to as a box. The coupling or box is a hollow cylinder having an inside wall that is threaded, which are referred to as female threads, for engaging the male-threaded end of a first sucker rod and the male-threaded end of a second sucker rod, which fastens or couples the first and second rods together in an end-to-end fashion. Sucker rods are connected together by couplings to extend thousands of feet down into a well for reciprocating a pump at the bottom of the length of rods for pumping oil to the surface. The couplings have a greater diameter than the rods, and the couplings tend to wear as they rub against the inside wall of the production tubing string.

For maintenance and repair, the sucker rods and pump are pulled out of the well from time to time. A workover rig is installed over the well, and the sucker rods are hoisted upwards a pull-length at a time and held in place while the length of rod pulled out of the well is removed from rod below by loosening a coupling connection. Loosening the coupling is often called breaking the joint. The length of rod pulled up and out of the well each time may be as much as three individual sucker rods, so not every coupling connection is broken loose from the two rods that are joined by the coupling. The lengths of rod are kept in order for reassembly and lowering back into the well in the same order.

A tool called a power sucker rod tong is used for coupling and de-coupling the rods with the couplings, which is referred to as making and breaking the joints. Power sucker rod tongs were developed many years ago, and U.S. Pat. No. 3,144,794, issued to Foster and incorporated by reference, provides a description of one such example. U.S. Pat. No. 6,374,706, issued to Newman on Apr. 23, 2002, and incorporated by reference, provides a more recent example of a power sucker rod tool. To understand how the sucker rod tool works, a more detailed description of the sucker rods is needed. An end of a sucker rod is cylindrical and has 2 or 3 or so inches of male threads at each end, which is referred to as a pin. A cylindrical shoulder protrudes radially from the rod at the base of the pin, and the shoulder is adapted to abut against an end of a coupling. Spaced immediately inwardly from the shoulder is a drive head that is typically square in cross-section, which provides opposing flat surfaces. The opposing flat surfaces, which are referred to as flats, can be engaged by an open-ended wrench sized to engage the flat surfaces. Sucker rod tongs have such an open-ended wrench, referred to as a backup wrench, for engaging the flats and holding the sucker rod to prevent rotation.

After a pull-length of sucker rod is pulled out of a well, the rod is held in place near the surface of the earth to keep it from falling into the well. Power sucker rod tongs are pulled manually into engagement with the sucker rod at a coupling. The backup wrench engages the flats of a rod below the coupling, and a carrier jaw in the tongs engage the flats of the rod above the coupling. Powered by a hydraulic fluid, the carrier jaw rotates to loosen either the rod above the coupling or the rod below the coupling from the coupling. Depending on which connection breaks loose, the coupling either stays on the rod above the coupling or on the rod below the coupling. The rod above the coupling is set aside in the order of withdrawal from the well so that during reassembly, the rod above the coupling, the coupling and the rod below the coupling mate properly.

Some of the couplings or boxes need to be replaced due to wear from sliding up and down inside the tubing or due to a concern that the coupling may fail after being placed back in service, such as due to a crack in the coupling. Couplings have been typically removed manually from the sucker rod on which the coupling remains after use of the power sucker rod tool. Manual removal often involves striking the coupling with a hammer to loosen the threads, which carries a risk of injury from the hammer glancing off and hitting someone. The couplings are made of a hardened steel that can chip or even burst under certain stresses imparted by twisting and hammering on the coupling, which can result in emitting a shard of metal that may become embedded in a person's body or eye. A pipe wrench may be used on the smooth, cylindrical coupling, but the hardened metal prevents the wrench from biting into the metal for a good grip, resulting in slippage that can cause injury. So much torque is required to break the threads loose that a pipe is often placed over the end of the pipe wrench for additional leverage. If the wrench slips suddenly, there is a risk of injury to the person or persons pulling or pushing on the pipe wrench and its extension, as well as a risk to other people working on the task. In addition to the risk of injury imposed, removing couplings from sucker rods is a labor-intensive and time-consuming process.

Inventors have developed tools for breaking a coupling loose from a sucker rod. U.S. Pat. No. 5,361,831, issued to Young, describes a rod coupling breakout device, which provides a cylindrical housing that fits over a coupling. A pair of opposed impact transmitting members pass through the housing. A hammer can be used to strike the impact transmitting members to loosen the threads, and in the event of a catastrophic failure of the coupling, the housing contains any shards that would otherwise have been emitted.

U.S. Pat. No. 5,010,635, issued to Clark, describes a sucker rod coupling breaking tool. A first, preferably stationary or non-rotatable, wrench is provided with a coupling engaging clamp apparatus that has a plurality of jaws or clamp members that that circumferentially extend about and encapsulate a coupling to hold it and prevent rotation. A second wrench is open ended and adapted to engage the square, flat portion of a sucker rod. The second wrench rotates the sucker rod while the first wrench holds the coupling, which unscrews the coupling from the sucker rod.

U.S. Pat. No. 5,433,128, issued to Wacker, describes a sucker rod coupling tool for either breaking or tightening the threaded joint between a sucker rod and a coupling. The tool has a friction wrench that engages the outside of the cylindrical coupling and a backup wrench that engages the square flats of the sucker rod. The backup wrench is stationary, and the friction wrench rotates the coupling to break the threads loose or to tighten them.

U.S. Pat. No. 6,942,254, issued to Cartsensen and incorporated by reference, describes another variation on a tool for making or breaking connections between a coupling and the pin end of a sucker rod. Several jaws move radially inwardly to clamp the coupling into a fixed position, and a wrench engages the square flats adjacent the pin end of the sucker rod. The wrench rotates while the jaws hold the coupling stationary to loosen or tighten the threaded joint.

Although there have been a number of advancements in this art, there remains a need for a tool that is convenient and easy to use. The tools described in the patents above may work quite well, but they are not typically being used in the field as sucker rod is removed from a well bore. When a coupling needs to be replaced, it is still generally done manually with hammers and pipe wrenches as described above. Thus, there remains a need for a tool for breaking the threaded joint between a coupling and a sucker rod that reduces the time required for this task and makes the task safer to perform.

SUMMARY OF THE INVENTION

The present invention provides a tool for removing a coupling from a sucker rod that reduces the time required to perform the task and makes the task safer to perform. In one embodiment the present invention provides a sucker rod tong comprising a body having an opening adapted to receive a sucker rod assembly, a rotatable jaw carrier assembly operably engaged in the body at the opening and adapted to engage the sucker rod assembly, a powered mechanism adapted to rotate the jaw carrier assembly; a lower backup wrench operably positioned with respect to the jaw carrier assembly; and a coupling extractor removably engaged with the jaw carrier assembly, where the coupling extractor comprises a shaft having an end adapted as an extractor for engaging the inside wall of a coupling for unscrewing the coupling from a sucker rod. In a preferred embodiment, both ends of the shaft are adapted as easy-out extractors, preferably as tapered spiral flutes, and the shaft preferably has at least one driving flange. Additional features such as a second drive flange and shields around the extractors are added in a preferred embodiment. The sucker rod tong preferably includes an upper backup wrench that extends to engage a sucker rod above a coupling while the coupling is rotated.

In another embodiment, the present invention provides a coupling extractor comprising a shaft having an extractor end adapted to engage the inside wall of a coupling. A preferred extractor end is a tapered, left-handed spiral fluted length. The shaft includes a drive portion for receiving a rotational force, preferably a driving flange that extends radially from the shaft. The coupling extractor preferably includes a second driving flange spaced apart from the first driving flange, and an optional centering flange extending radially from the shaft is preferred for positioning the coupling extractor inside of a jaw assembly in a sucker rod tong. In one embodiment, the shaft has an extractor end on the other end also, and each extractor end is preferably surrounded by a safety shield.

BRIEF DESCRIPTION OF THE DRAWINGS

A better understanding of the invention can be obtained when the detailed description of exemplary embodiments set forth below is considered in conjunction with the attached drawings in which.

DETAILED DESCRIPTION OF THE EXEMPLARY EMBODIMENTS

The present invention provides an improved powered sucker rod tong for breaking loose a threaded connection between a sucker rod and a coupling or box threaded onto an end of the sucker rod. As described in the background section above, a sucker rod typically comprises a cylindrical rod of metal about 25 to 30 feet long with male threads on each end. The rods are connected end to end by a coupling referred to in the industry as a box. Sucker rods are connected together end to end by couplings to extend thousands of feet down into a well for reciprocating a pump at the bottom of the length of rods for pumping oil to the surface. To perform maintenance or repair, the assembly of rods, couplings and the pump is hoisted out of the well a pull-length at a time. A pull-length may include up to three sucker rods fastened end to end by two couplings.

A powered sucker rod tong is used to unscrew a coupling between pull-lengths, which leaves the coupling attached to either the pull-length above the coupling or to the pull-length below the coupling. Consequently, a pull-length may have a coupling on each end, a coupling on only the top or only the bottom, or no coupling at all. The pull-lengths are kept in order for reassembly in the original order. Couplings have a greater diameter than the sucker rods and provide a wear surface as the sucker rod assembly reciprocates inside the production tubing. Some or all couplings may be replaced due to wear, damage, fatigue or a combination of such factors. The present invention pertains to removing a coupling that remains on a pull-length after a powered sucker rod tong has been used to unscrew an upper pull-length from a lower pull-length, leaving the coupling on either the upper pull-length or on the lower pull length. The coupling will be replaced, so damage to the coupling during removal is not a concern.

Figure 1:
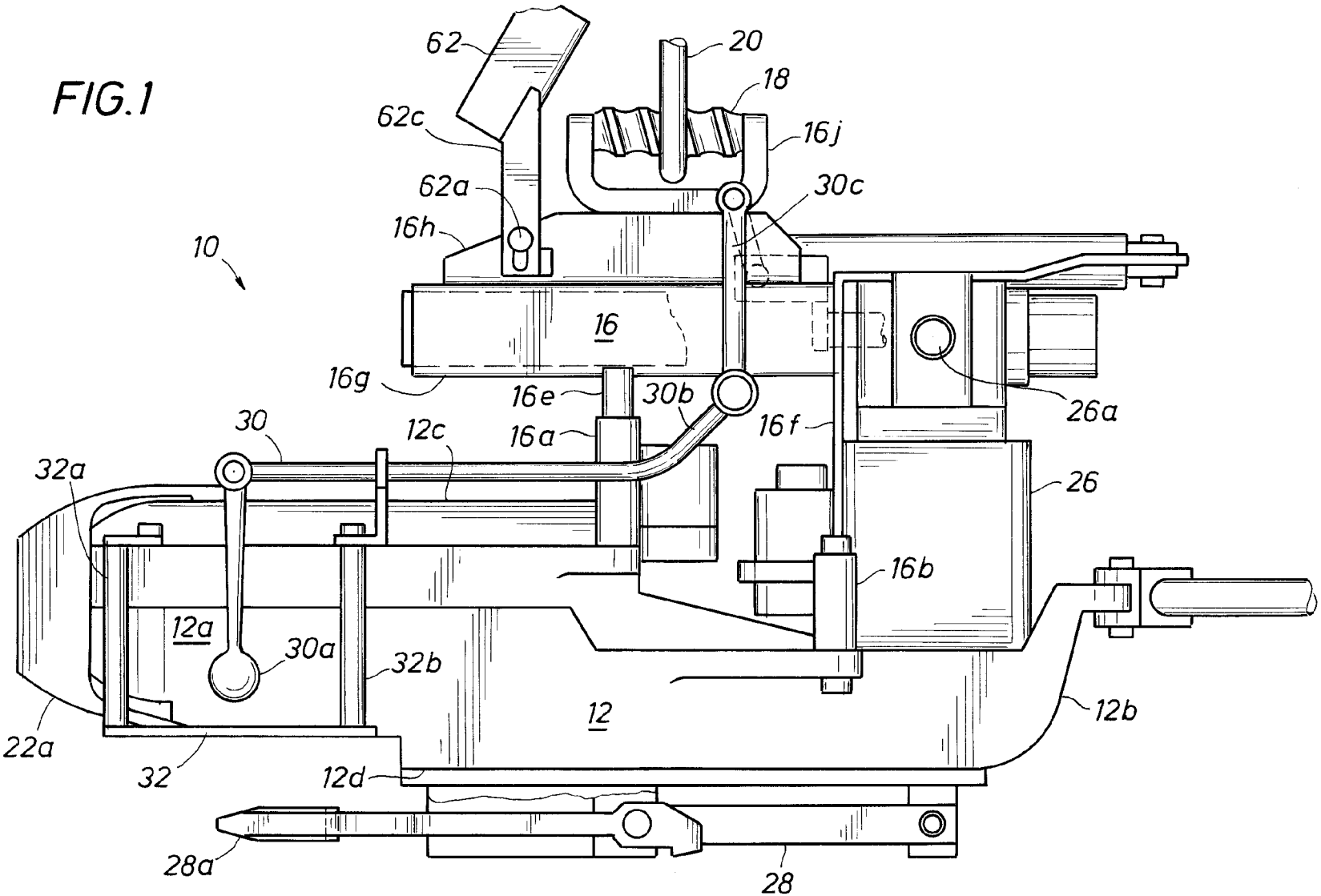
FIG. 1 is a right side view of a sucker rod tong according to the present invention.

Turning to the drawings, FIG. 1 is a right side view of an improved sucker rod tong 10 according to the present invention. Sucker rod tong 10 includes a body 12 having a front portion 12*a*, a rear portion 12*b*, an upper portion 12*c* and a lower portion 12*d*. A hanger assembly 16 bolts to body 12 through cylinders 16*a* and 16*b* (and 16*c* and 16*d* on the left side shown in FIG. 3). Hanger assembly 16 has a front upright member 16*e*, a rear upright member 16*f*, a tubular member 16*g* having a rectangular cross-section, a right upright member 16*h*, a left upright member 16*i* (shown in FIG. 3), and a U-shaped screw-support member 16*j*. A hanger balancing screw 18 is received in screw-support member 16*j*, and a hoist hook 20 engages turn-bolt 20 for supporting sucker rod tong 10.

Figure 2:
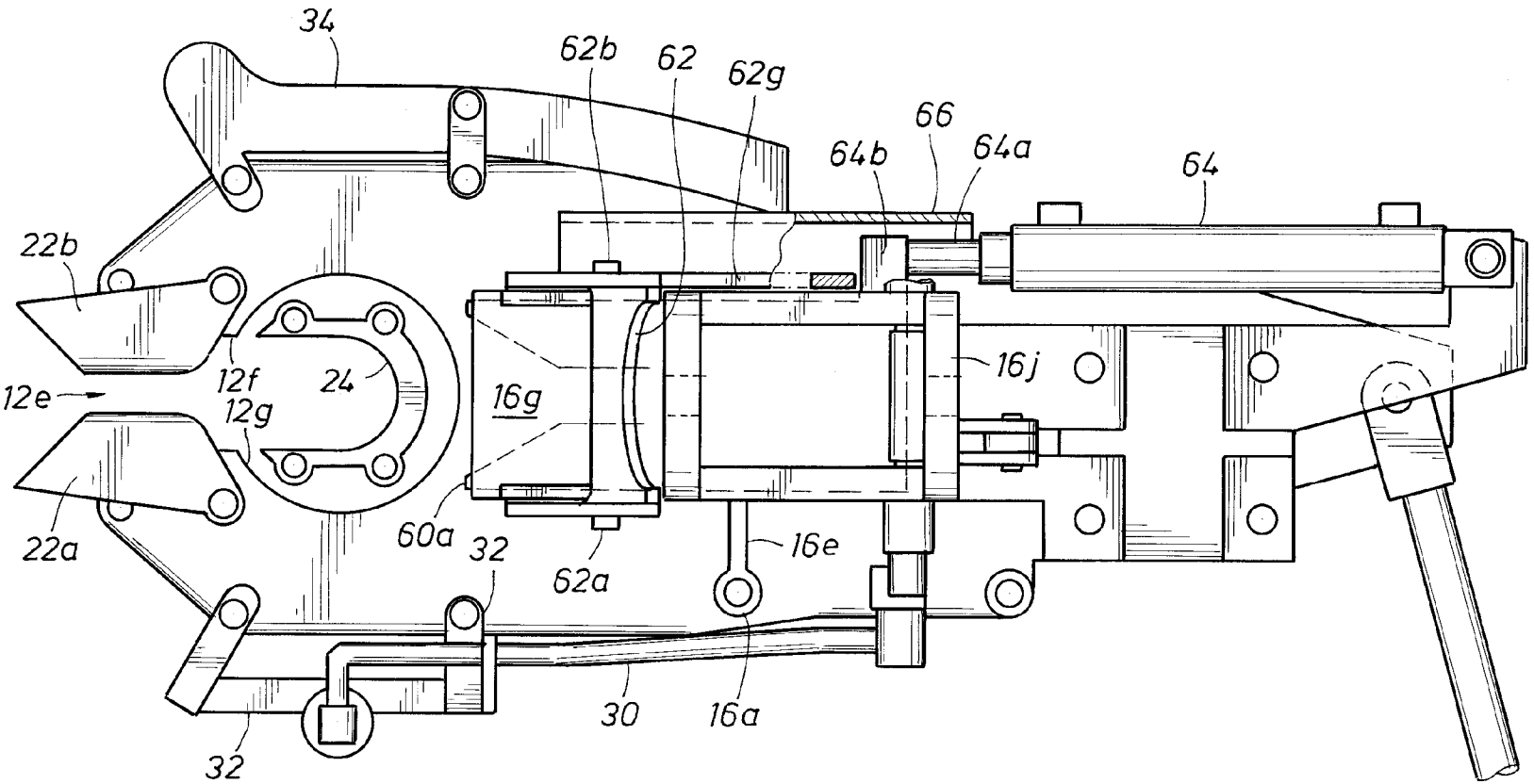
FIG. 2 is a top view of the sucker rod tong of FIG. 1.
Figure 3:
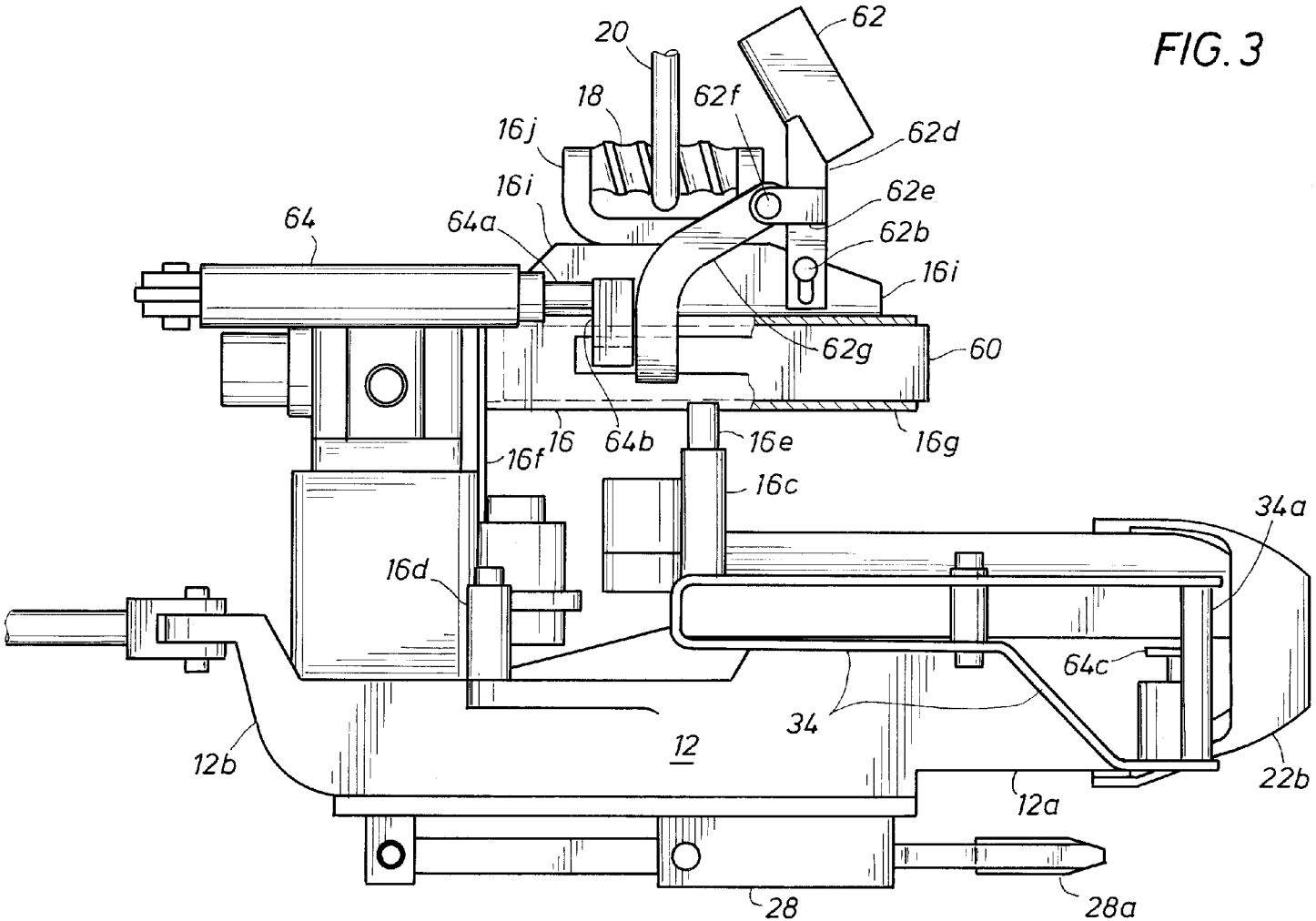
FIG. 3 is a left side view of the sucker rod tong of FIG. 1 shown in partial cross-section.

FIG. 2 provides a top view of sucker rod tong 10, and FIG. 3 provides a left side view of tong 10. With reference to FIG. 2, front portion 12*a* of body 12 has an opening 12*e* comprising a mouth portion 12*f* and a circular portion 12*g*. Opening 12*e* is sized to accommodate a sucker rod assembly (not shown). Gates 22*a* and 22*b* are pivotally connected to body 12, and springs (not shown) hold gates 22*a* and 22*b* in a normally-closed position. A jaw assembly 24 (FIG. 2) is received in circular portion 12*g* of opening 12*e* in body 12. Jaw assembly 24 is rotated by a series of gears (not shown). Hydraulic fluid enters a hydraulic motor in a transmission gear box 26 through a port 26*a*. Hydraulic fluid turns the hydraulic motor, which turns gears to rotate jaw assembly 24.

A lower backup wrench assembly 28 is fastened to bottom portion 12*d* of body 12, as shown in FIGS. 1 and 3. Backup wrench assembly 28 terminates in an open-ended, U-shaped wrench head 28*a*, which is sized to operatively engage the square portion of a sucker rod drive head referred to as the flats of the sucker rod. As can be seen in FIGS. 1 and 2, a control arm 30 has a control operator 30*a* connected rigidly to a bent arm portion 30*b*, which is connected to an upright portion 30*c*. An operator pulls control arm 30 forward to cause jaw assembly 24 to rotate and pushes control arm 30 back to a stopped position to stop the rotation. Right hand grips 32*a* and 32*b* (FIG. 1), which are attached to body 12 by grip frame 32, and left hand grip 34*a* (FIG. 3), which is attached to body 12 by grip frame 34, provide a place for an operator to grip sucker rod tong 10 to move it around.

Figure 4:
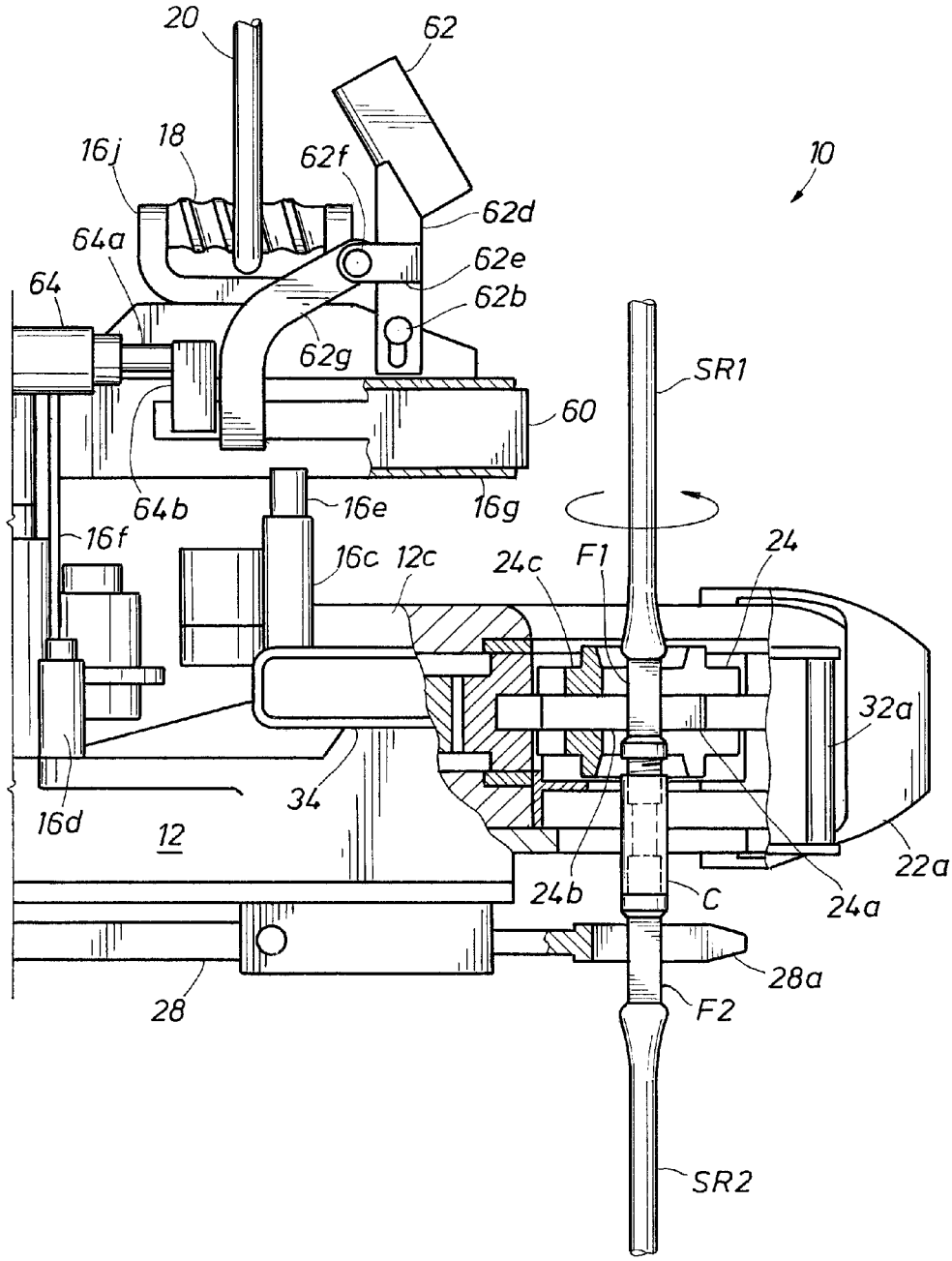
FIG. 4 is a partial left side view of a sucker rod tong shown in partial cross-section, according to the present invention, and a side view of a sucker rod assembly.

With reference to FIG. 4, which is a left side view of sucker rod tong 10 in partial cross-section, in operation, a pull-length of sucker rod SR1 is hoisted upward using rod elevators in a workover rig (not shown) until a coupling C is at about the height of sucker rod tong 10, which is at about waist high above the floor of the rig. A sucker rod SR2 immediately below coupling C is held in place using the rod elevators to prevent the rod assembly from falling into the well bore. The pull-length of sucker rod SR1 above the coupling is supported by the rig hoist system. An operator grabs hand grips 32*a* and 34*a* and pulls sucker rod tong 10 forward and side to side to engage backup wrench head 28*a* with the flats F2 on the sucker rod SR2 below coupling C. Jaws 24*a* and 24*b* within jaw assembly 24 engage the flats F1 of the sucker rod above the coupling. While lower backup wrench 28 prevents rotation of the sucker rod SR2 below the coupling, the operator pulls control operator 30*a* forward, which manipulates a valve in the hydraulic system causing jaws 24*a* and 24*b* and jaw assembly 24 to rotate, unscrewing the upper sucker rod SR1 from the coupling C or unscrewing the coupling C from the lower sucker rod SR2. FIG. 4 shows the upper sucker rod SR1 breaking loose from the coupling C, but in some cases the coupling C remains attached to the upper sucker rod SR1 and instead breaks loose from the lower sucker rod SR2. The pull-length of sucker rod SR1, which may or may not have the coupling C attached to its bottom end, is set aside, and the operation is repeated to remove another pull-length of sucker rod.

Assume that coupling C is worn, damaged and/or cracked and needs to be replaced. As described in the background section above, prior art removal of coupling C from sucker rod SR1 or SR2 generally involved manually striking the coupling to loosen the threaded connection, which sometimes caused the coupling to break and emit shards of metal that could injure someone, in addition to the potential for injury from getting hit by a hammer. A pipe wrench, with a pipe extension on the handle, was used to grasp the coupling C, but because the coupling is made of a hardened metal, the pipe wrench would often slip, which sometimes led to injury. Thus, the prior art method was labor intensive, time consuming and prone to cause injury.

Figure 6:
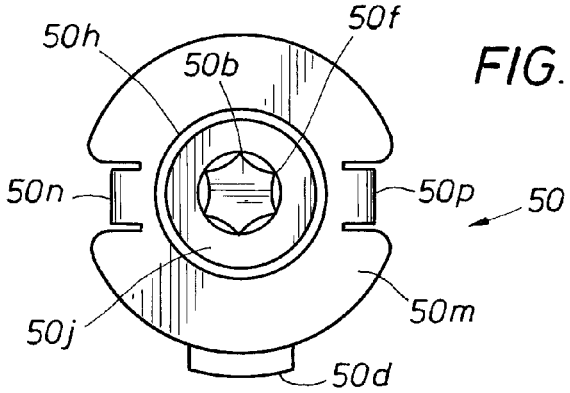
FIG. 6 is a top plan view of the coupling extractor of FIG. 6.
Figure 5:
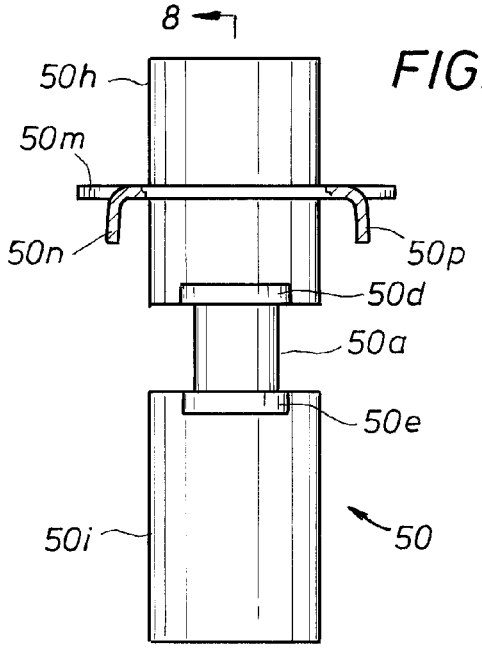
FIG. 5 is a side elevation view of a coupling extractor according to the present invention.
Figure 8:
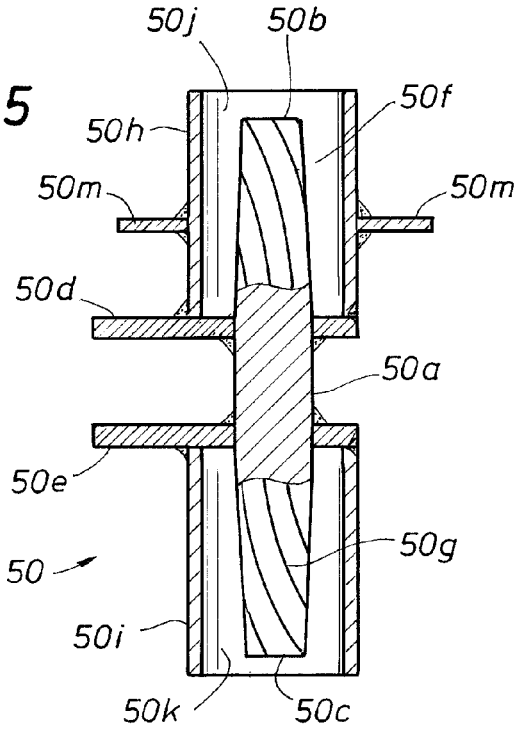
FIG. 8 is a side elevation cross-section of the coupling extractor of FIG. 6.
Figure 7:
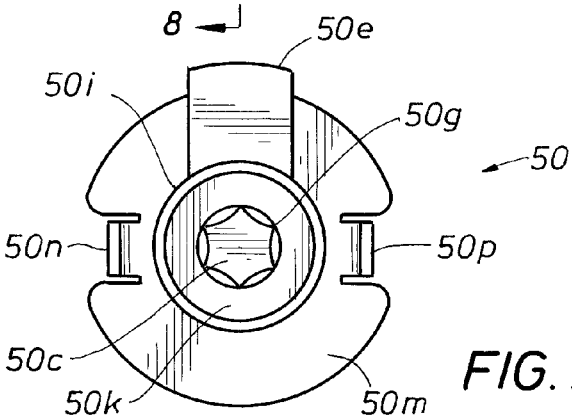
FIG. 7 is a bottom plan view of the coupling extractor of FIG. 6.

Turning to FIGS. 5-8, the present invention provides a coupling extractor that fits inside jaw assembly 24 in sucker rod tong 10 for removing a coupling from a sucker rod. FIG. 5 shows a side view of a coupling extractor 50, according to the present invention; FIG. 6 shows a top view; FIG. 7 shows a bottom view; and FIG. 8 shows a side view in cross-section. In this particular embodiment of the present invention, coupling extractor 50 includes a cylindrical shaft 50*a* having an upper end 50*b* and a lower end 50*c*. A first driving shaft 50*d* and a second driving shaft 50*e* each extend radially outward from shaft 50*a*. Driving flanges 50*d* and 50*e* surround shaft 50*a* and extend a radius r1 for about a 270 degree arc and extend farther to a radius of r2 for about a 90 degree arc. Radius r2 is greater than radius r1. These particular aspects of the invention are not critical as will become more clear after an explanation as to how coupling extractor 50 is used.

With reference to FIG. 8, a length inward from each of ends 50*b* and 50*c* is tapered and carved or engraved to form spiral flutes 50*f* and 50*g*, respectively. While threads on a sucker rod and inside a coupling are considered right-handed threads, the spiral flutes are curved in a left-handed orientation. The spiral flutes are sized and designed to bite into the inside, threaded wall of a coupling to unscrew the coupling from a sucker rod. In a prototype of the present invention, shaft 50*a* was made by welding together the bases of two "easy-out" extractors, aligning the extractors end to end along a common axis. The term "easy-out" seems to be a generic description of a tool that cuts into or engages a cylindrical inside wall to twist a threaded cylinder in a counterclockwise direction in order to unscrew a threaded connection. The tapered, left-handed spiral flutes are preferred, but easy-out extractors are available in other shapes including a tapered square shape. For the present invention, a class of tools referred to as pipe nipple extractors are suitable, and an internal pipe wrench can also be adapted as a coupling engaging member. U.S. Pat. Nos. 4,604,917, issued to Polonsky, and 5,906,146, issued to Arlen, and 4,688,315, issued to Jannke, describe various extractors and are incorporated by reference.

In an embodiment preferred for safety reasons, shields 50*h* and 50*i* surround the spiral fluted lengths 50*f* and 50*g*, respectively, as can be seen in FIGS. 6-8. Shields 50*h* and 50*i* protect an operator from flying debris if a coupling breaks or chips. Shields 50*h* and 50*i* are preferably cylindrical in shape and have a diameter sufficiently large to provide annular spaces 50*j* and 50*k*, respectively, which are large enough to accommodate the wall thickness of a coupling. A centering flange 50*m* extends radially 360 degrees from upper shield 50*h*. Two tabs 50*n* and 50*p* are formed in centering flange 50*m* and bent downward 90 degrees with respect to the centering flange 50*m*.

In the prototype of the invention, plates were cut to provide a suitable shape for the driving flanges 50*d* and 50*e*. Holes having a diameter slightly larger than the shaft 50*a* were cut or drilled in the plates forming driving flanges 50*d* and 50*e*. Shaft 50*a* was placed through the holes, and the plates were welded to the shaft 50*a* to form the driving flanges 50*d* and 50*e*. Pipes, which formed shields 50*h* and 50*i*, were welded to the plates that form driving flanges 50*d* and 50*e*. Centering flange 50*m* was formed from a plate having a hole cut or drilled to slightly larger than the outside diameter of shield 50*h*. The plate forming centering flange 50*m* was welded to the pipe forming shield 50*h*. In production manufacturing, shaft 50*a* may be an integral cylindrical rod forged or cut to form the tapered, spiral fluted lengths 50*f* and 50*g*. Shield 50*h* and driving flange 50*d* may be formed as an integral piece that is then welded onto shaft 50*a*. Shield 50*i* and driving flange 50*e* may also be formed as an integral piece, but centering flange 50*m* would likely be made as a separate piece that is then welded to upper shield 50*h*.

Figure 9:
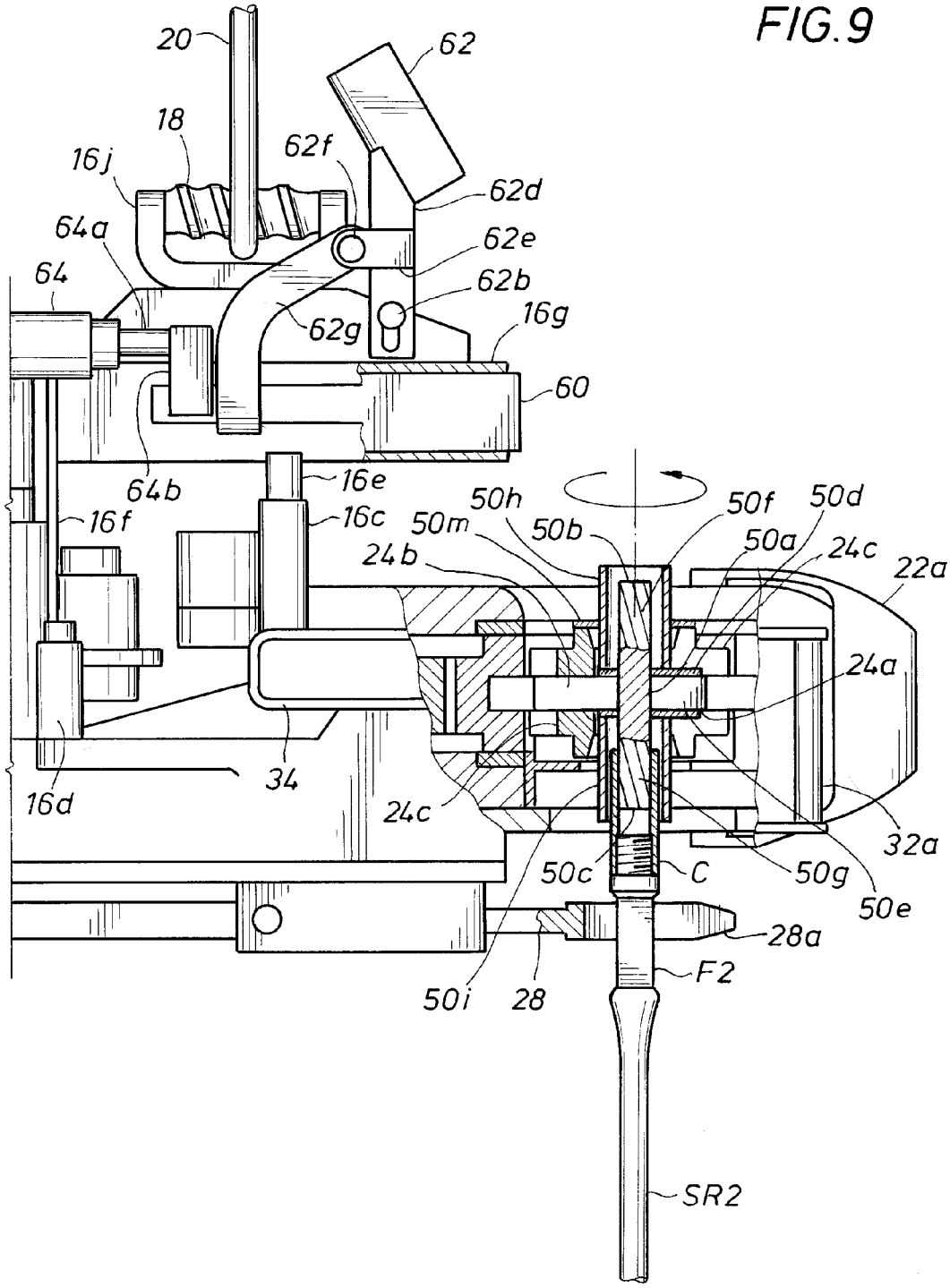
FIG. 9 is a partial left side view, shown in partial cross-section, of a sucker rod tong fitted with a coupling extractor and showing how a coupling is unscrewed from a sucker rod below the coupling, according to the present invention.

Turning now to FIG. 9, which is a left side view of sucker rod tong 10 in partial cross-section, coupling extractor 50 is used to remove a coupling. In this embodiment, coupling C remained on sucker rod SR2 after the upper sucker rod SR1 was removed. Coupling C is assumed to be worn, damaged and/or cracked and needs to be replaced. While sucker rod tong 10 remains in place after sucker rod SR1 is removed, coupling extractor 50 is placed inside jaw assembly 24. Centering flange 50*m* and tabs 50*n* and 50*p* are sized and located to fix coupling extractor 50 in essentially the center of opening 12*g* (FIG. 2), which is the opening in which jaw assembly 24 is received. Lower end 50*c* of shaft 50*a* goes inside an upper portion of coupling C, where the threads of sucker rod SR1 had been previously engaged. Coupling C fits within annular space 50*k*, and lower shield 50*i* surrounds the upper half of coupling C.

Jaw assembly 24 includes an inner ring 24*c* that rotates when hydraulic force is applied through the gear system (not shown). Inner ring 24*c* presses against driving flanges 50*d* and 50*e* to rotate coupling extractor 50. Jaws 24*a* and 24*b* are fastened to inner ring 24*c* and rotate as inner ring 24*c* rotates. Jaws 24*a* and 24*b* move inward and wrap around shaft 50*a* between upper driving flange 50*d* and lower driving flange 50*e* as jaw assembly 24 begins to rotate. Upper driving flange 50*d* and lower driving flange 50*e* form shoulders with respect to shaft 50*a*, and jaws 24*a* and 24*b* fit between the shoulders and around shaft 50*a*, which restricts axial movement of coupling extractor 50. In a less preferred embodiment, shaft 50*a* has a central portion with a square cross-section of about the same size as the flat section of a sucker rod; the jaws engage and rotate the coupling extractor; and the driving flanges are eliminated.

Coupling C, which is more tightly engaged with sucker rod SR2 than it was with sucker rod SR1 since it remained with sucker rod SR2, is loosened from tight engagement with the upper threaded end of sucker rod SR2 as follows. Lower backup wrench 28 holds and prevents sucker rod SR2 from rotating. An operator manipulates control operator 30*a* (FIG. 1) to cause jaw assembly 24 to rotate in a counterclockwise direction for unscrewing coupling C from sucker rod SR2. Inner ring 24*c* of the jaw assembly 24 rotates, engages and presses against the driving flanges 50*d* and 50*e*, causing the coupling extractor 50 to rotate. The tapered spiral fluted length 50*g* of shaft 50*a* has a left-handed thread in the form of the raised flutes. The tapered spiral fluted length 50*g* screws, cuts and bites into the inside wall of coupling C getting tighter and tighter as jaw assembly 24 rotates until coupling C breaks loose from the threads on sucker rod SR2. The operator can continue to rotate jaw assembly 24 until coupling C is completely unscrewed from sucker rod SR2. The operator can then pull the coupling extractor 50 out of sucker rod tong 10. If the coupling C remains engaged with the tapered spiral fluted length 50*g*, it can be easily loosened by hand or with gentle taps from a hammer.

Shield 50*i* is an optional feature of the present invention, but because coupling C is made of a hardened metal, it is brittle and can shatter as the tapered spiral fluted length 50*g* digs and grinds into the inside wall of the coupling. Shield 50*i* should contain most of the shards in the event that coupling C shatters, bursts or otherwise breaks, which makes the task of removing couplings safer for the operator. The upper portion of coupling extractor 50, particularly the fluted portion 50*f*, was not used to remove coupling C from sucker rod SR2. The upper portion of the coupling extractor provides optional features, which are not critical to the present invention. The present invention provides a coupling extractor having a coupling engaging member adapted to engage the inside wall of a coupling, and the present invention provides an improved sucker rod tong by combining the coupling extractor with a prior art sucker rod tong.

Figure 10:
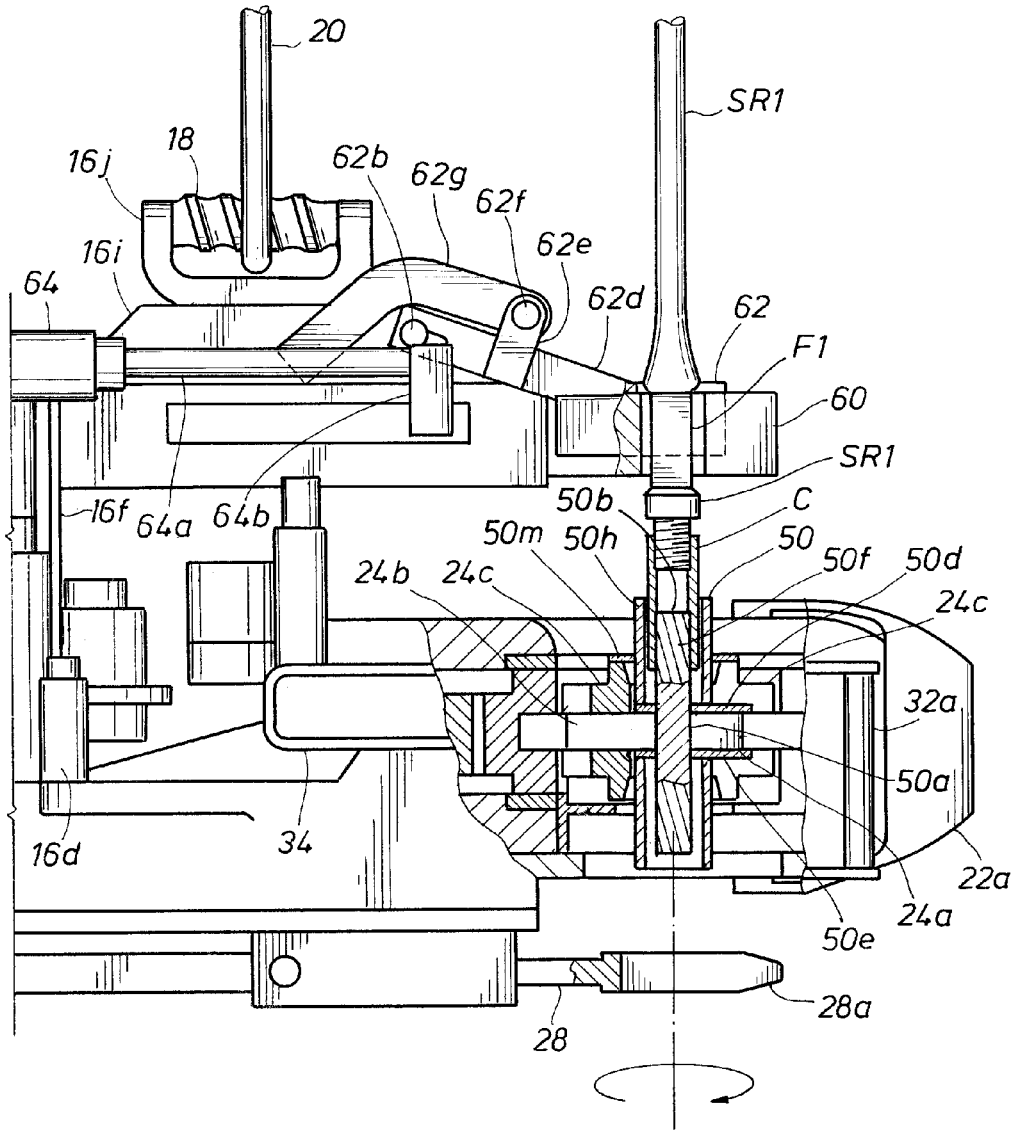
FIG. 10 is a partial left side view, shown in partial cross-section, of a sucker rod tong fitted with a coupling extractor and showing how a coupling is unscrewed from a sucker rod above the coupling, according to the present invention.

With reference to FIG. 10, one can see that coupling extractor 50 can also be used to remove coupling C when it remains attached to the upper sucker rod SR1. After the connection between coupling C and the sucker rod below breaks and is unthreaded entirely, the operator moves a direction control element in the jaw assembly 24 to reverse the direction of rotation. The operator places the coupling extractor 50 inside jaw assembly 24 of sucker rod tong 10. Centering flange 50*m* and tabs 50*n* and 50*p* are designed and sized with respect to the jaw assembly 24 to fix the position of the coupling extractor 50 in a desired position, both axially and radially. With coupling extractor 50 located inside jaw assembly 24, sucker rod tong 10 and/or sucker rod SR1 are moved into engagement so that the upper spiral fluted length 50*f* slides inside coupling C while coupling C slides into the annular space 50*j* between the outside surface of the fluted portion 50*f* and the inside surface of the shield 50*h*.

An upper backup wrench 60 is engaged with the flats F1 of upper sucker rod SR1 to hold and prevent sucker rod SR1 from rotating. The operator moves control operator 30*a* (FIG. 1) to cause jaw assembly 24 to rotate to unscrew coupling C from sucker rod SR1. Inner ring 24*c* of the jaw assembly 24 rotates, engages and presses against the driving flanges 50*d* and 50*e*, causing the coupling extractor 50 to rotate. The direction of the rotation is opposite of what was used to remove the coupling from the lower sucker rod, but it is still referred to as a counterclockwise direction because the direction is viewed as looking through sucker rod tong 10 toward the end of sucker rod SR1. As jaw assembly 24 begins to rotate, jaws 24*a* and 24*b* move radially inward and wrap around shaft 50*a* between the shoulders formed by driving flanges 50*d* and 50*e*. The tapered, spiral fluted length 50*f* burrows into the inside wall of coupling C, not following the threads inside coupling C but instead cutting across the threads in an opposite rotational direction. The spiral flutes will generally engage and burrow into the coupling, but the operator can provide manual assistance to start the engagement, and in any case, the jaws 24*a* and 24*b* hold the coupling extractor 50 against axial movement.

As jaw assembly 24 rotates, spiral fluted end portion 50*f* (FIG. 10) becomes more and more tightly engaged with the inside wall of coupling C until the threaded engagement between coupling C and sucker rod SR1 breaks free. Rotation continues until coupling C is completely disengaged from sucker rod SR1. Upper backup wrench 60 is disengaged from the flats F1 of sucker rod SR1, and a hoist in the workover rig is operated to move sucker rod SR1 out of the way so that the work of pulling the sucker rod assembly out of the well bore can continue. The operator pulls the coupling extractor 50 out of the jaw assembly 24 of sucker rod tong 10 and removes and discards the coupling. The threads inside the coupling are damaged during the removal process, so coupling extractor 50 is preferably used to remove worn or damaged couplings that should be discarded.

While continuing to reference FIG. 10, turn also to FIG. 3 for a further description of the upper backup wrench 60. A prior art sucker rod tong typically had only a single, lower backup wrench. The improved sucker rod tong 10 has lower backup wrench 28 and upper backup wrench 60. To engage upper backup wrench 60 on the flats of a sucker rod above a coupling in sucker rod tong 10, the operator flips down a safety cover 62 that is pivotally connected by pins 62*a* and 62*b* and connecting members 62*c* and 62*d* to upright members 16*h* and 16*i*, respectively, of hanger assembly 16. See FIGS. 1 and 3. A transverse connecting member 62*e* is welded to connecting member 62*d* at a right angle and is pivotally connected by a pin 62*f* to a curved member 62*g* which is pivotally connected by a pin 62*h* (not shown) to a shield 62*i* (not shown) that is attached to hanger assembly 16. A spring 62*j* (not shown) preferably extends between a base of transverse connecting member 62*e* and a front portion of curved member 62*g* for holding safety cover 62 down.

A pneumatically-powered piston 64 has a piston rod 64*a* connected by a linkage 64*b* to a rear portion of upper backup wrench 60. Piston 64 is activated by depressing a thumb valve 64*c* located adjacent to hand grip 34*a*, as shown in FIG. 3. The operator flips down safety cover 62, and depresses thumb valve 64*c* to extend upper backup wrench 60 forward into engagement with the flats F1 of upper sucker rod SR1. With reference to FIG. 2, a piston rod safety shield 66 is shown partially cut away and preferably covers piston rod 64*a*. Piston rod safety shield 66 is not shown in FIGS. 3, 4, 9 and 10 so that parts covered by shield 66 can be seen more clearly. Not shown in any of the figures is an alternative embodiment of the upper backup wrench in which a backup wrench is pinned or hinged to a hanger assembly or to the body of the sucker rod tong, where the upper backup wrench is normally in a raised position and lowered when needed, which may be done manually or with a piston.

A pneumatic control system is used to operate upper backup wrench 60. The pneumatic control system is not shown in the various views to keep the drawings from becoming confusing. Air is conveyed from a compressor via a tube to an air pressure regulator, which is preferably set for about 60 pounds pressure per square inch gauge pressure (psi). Control and movement of backup wrench 60 is erratic at pressures higher than about 70 psi and sluggish at pressures lower than about 40 psi. Air flow is split and directed to a relay valve (available from Williams Controls as part no. WM-147-F), which is normally open, and to thumb valve 64*c* (a push-button valve available from Williams Controls as part no. WM-148-A). The relay valve has an inlet port in fluid communication with the outlet side of the air pressure regulator and an outlet port. Piston 64 has a rear port for receiving air to extend piston rod 64*a* and a forward port to receive air to retract piston 64*a*. Tubes teed together connect an outlet side of the thumb valve and a pilot port of the relay valve with the rear inlet port in piston 64 for extending piston rod 64*a* forward. The relay valve also has an outlet port in fluid communication with the forward port in piston 64 and with a pin valve (available from Clamping Cylinder Co. as part no. 03351-0515). The pin valve has a pin for engaging upper backup wrench 60 to lock it in a retracted position when air is in the system, and a spring to pull the pin back to unlock the upper backup wrench when air is off the retract port of piston 64. Air pressure is required to extend the upper backup wrench, but air pressure also normally activates the pin valve to lock the upper backup wrench in the retracted position.

Air pressure on the pin valve provides one safety feature for preventing unintended extension of piston rod 64*a*, while the requirement to flip safety cover 62 down provides a second safety feature for preventing unintended extension of piston rod 64*a*. Thumb valve 64*c* should be depressed to put air pressure on the extension side of piston 64, and when it is no longer depressed, air bleeds through an exhaust line in the relay valve. As air bleeds through the exhaust line, pressure on the extend side of piston 64 decreases while pressure on the retract side increases, causing piston rod 64*a* to retract and the pin valve to extend and hold the upper backup wrench in its retracted position.

With reference to FIG. 2, upper backup wrench 60 is a rectangular plate of metal having a Y-shaped notch at its front end 60*a*. The Y-shaped notch is hidden by tubular member 16*g*, but is shown as dashed lines. The flats of a sucker rod are received in the portion of the Y-shaped notch that has parallel sides. Upper backup wrench 60 is supported by and slides within tubular member 16*g* of hanger assembly 16. Tubular member 16*g* has a rectangular cross-section, and upper backup wrench 60 is supported on an inside bottom surface of tubular member 16*g*. Backup wrench 60 presses against the inside walls of tubular member 16*g* while resisting torque and rotational forces when in use to hold a sucker rod. The pin valve (not shown) that locks backup wrench 60 in a retracted position passes through a hole (not shown) in the bottom wall of tubular member 16*g* and is received in a hole (not shown) near the back end of upper backup wrench 60.

In the embodiment of the invention described herein, sucker rod tong 10 comprises a BJ Power Sucker Rod Tong Model Mark IV that has been modified according to the present invention. The BJ Power Sucker Rod Tong Model Mark IV can be purchased from Cavin Oil Well Tools, Inc. as well as from other manufacturers. The BJ Model Mark IV has jaw assembly 24. Other models of the BJ Power Sucker Rod Tong and other manufacturers having a similar design of a tong with a jaw assembly are easily improved according to the present invention, and different tong designs can also be improved according to the present invention. Sucker rod tongs from other manufacturers, which also have an inner ring jaw mechanism, include Gill Services, Inc. of Houston, Tex. with its Foster sucker rod tongs, Tillery & Parks Co. of Odessa, Tex., D&D Tong Service of Abilene, Tex., Carter Tool Co. of Odessa, Tex. and Weatherford Drilling and International Services of Ventura, Calif. through its subsidiary, Oil Country Manufacturing, Inc.

In summary, the present invention provides in one embodiment a sucker rod tong comprising a body having an opening adapted to receive a sucker rod assembly, a rotatable jaw carrier assembly operably engaged in the body at the opening and adapted to engage the sucker rod assembly, a powered mechanism adapted to rotate the jaw carrier assembly and a lower backup wrench operably positioned below the jaw carrier assembly; a coupling extractor removably engaged with the jaw carrier assembly, the coupling extractor comprising a shaft having an end adapted as an extractor for engaging the inside wall of the coupling for unscrewing the coupling from the sucker rod. In a preferred embodiment, both ends of the shaft are adapted as easy-out extractors, preferably as tapered spiral flutes, and the shaft preferably has at least one driving flange. Additional features such as a second drive flange and shields on the extractors are desirable, but not essential. The sucker rod tong preferably includes an upper backup wrench, which is preferably normally retracted but extendable, preferably by pneumatic control, and preferably fitted with a safety cover. Although the sucker rod tong is normally operated in a horizontal position for work on a vertical sucker rod assembly, the present invention can be used to remove a coupling from a horizontal sucker rod having a coupling that needs to be removed, although some modifications may be preferred.

In another embodiment, the present invention provides a coupling extractor that can be sold as a product or as a replacement part for the sucker rod tong described above. The coupling extractor comprises a shaft having an end that is an extractor, such as an easy-out extractor, a pipe nipple extractor or an internal pipe wrench. While the shaft may have a square cross-section for engagement by the jaws in a jaw assembly of a sucker rod tong, the shaft is preferably cylindrical and preferably includes a driving flange that extends radially from the shaft. An optional second driving flange can be used, and an optional centering flange is preferred.

Another embodiment of the present invention provides a product kit containing parts for retrofitting a prior art sucker rod tong to improve it according to the present invention. The inventive product kit preferably includes a coupling extractor of at least the simplest form and a hanger assembly, preferably a hanger assembly having the shape and features described herein with respect to hanger assembly 16, and an upper backup wrench adapted for cooperation with the hanger assembly. Optional, but preferred, elements include a safety cover such as safety cover 62 and its operating members, a piston for extending the upper backup wrench, and control parts, such as control arm 30 and a pneumatic control system.

A further embodiment of the present invention provides a method for breaking loose a worn or damaged coupling from a sucker rod. The steps preferably include hoisting a pull-length of a sucker rod assembly out of a well bore; engaging a jaw assembly of a sucker rod tong with the sucker rod assembly at a coupling joining first and second sucker rods; unthreading the coupling from the first sucker rod; placing a coupling extractor in the jaw assembly, wherein the coupling extractor comprises a shaft having an extractor end portion adapted to grip the inside wall of the coupling; engaging the extractor end portion with the inside wall of the coupling; and operating the sucker rod tong to rotate the jaw assembly, thereby rotating the coupling extractor, wherein the extractor end portion engages the inside wall of the coupling and unscrews the coupling from the second rod.

In a preferred embodiment of the method, the coupling extractor has one or more of the features described in FIGS. 5-8, particularly a driving flange, and the sucker rod tool has both a lower backup wrench that can be used when a coupling remains on a sucker rod below the coupling and an upper backup wrench that can be used when a coupling remains on a sucker rod above the coupling. The upper backup wrench is preferably normally retracted, but extendable, preferably using an electrical control system, a hydraulic control system or a pneumatic control system.

Removing a coupling from a sucker rod in the past generally involved manually striking the coupling with a hammer to loosen the threaded connection. Couplings are made of a hardened metal, and striking a coupling with a hammer sometimes causes the coupling to break and emit shards of metal that can injure someone. The person using the hammer, as well as co-workers helping to remove the coupling, can be injured by getting hit with the hammer, such as when the hammer hits the rounded coupling and glances off. After the threads were loosened by striking with the hammer, a pipe wrench, with a pipe extension on the handle, was used to grasp and rotate the coupling, often with two or three people pulling or pushing on the pipe extension. Because the coupling is made of a hardened metal, the pipe wrench would often slip, which sometimes led to injury, such as by the workers falling over and/or the wrench and pipe extension falling on or hitting someone. The prior art method for removing a coupling from a sucker rod, particularly while a rod assembly was being taken out of a well or while being put back into a well, sometimes led to an injury to the people performing the task. In addition, the task was labor intensive and time consuming, and thus, it was costly to make up and to break out a sucker rod assembly.

In contrast, the present invention provides a safer and less costly way to make up or break out a sucker rod assembly. A sucker rod tong was used in the prior art, and the prior art sucker rod tong can be improved according to the present invention. With the present invention, when workers encounter a coupling that needs to be replaced, a worker merely inserts the coupling extractor into the jaw of the sucker rod tong. If the coupling is on an upper end of a rod in a well, a prior art sucker rod tong can be used, without modification, to remove the coupling with the coupling extractor received in its jaw, in which case the coupling extractor needs only one end of its shaft adapted to engage the inside wall of the coupling. This may be all that is needed when breaking a rod assembly out of a well, where the rods removed will be laid out horizontal. It is easier and safer to remove a coupling from a rod lying in a horizontal position, so the prior art hammer and pipe wrench method can be used to remove couplings that are on a bottom end of rods pulled out of a well. Thus, the coupling extractor alone, when used with a prior art sucker rod tong, provides a substantial improvement in safety and a substantial reduction in time to make up or break out a sucker rod assembly. However, a sucker rod tong improved according to the present invention and used with a coupling extractor as taught herein provides a greater improvement in safety with less likelihood of injury to a worker, as well as a greater improvement in time efficiency, resulting in lower labor cost, and probably more importantly, less time for a well to be out of service for repair and maintenance.

These improvements are achieved because an improved sucker rod tong can be used the same as a prior art sucker rod tong to make up rods as they are lowered into a well and to break out rods as they are removed from a well. With the improved sucker rod tong, when a worker discovers a coupling that needs to be replaced, the worker simply drops the coupling extractor into the jaw of the tong and operates the tong to remove the coupling form its rod. After the coupling is removed from its rod, the coupling extractor is removed from the jaw of the tong. A new coupling is threaded onto the rod, and the make-up or break-out process continues. The chance of injury to a worker using the improved sucker rod tong and the coupling extractor is substantially reduced as compared to the prior art method of using a hammer and a pipe wrench. The present invention provides an improvement in both safety and monetary efficiency over the prior art hammer and pipe wrench method for removing couplings. The present invention is also an improvement over prior art tools for loosening a coupling, such as described by Wacker in his U.S. Pat. No. 5,433,128, because people in this industry prefer to use a standard sucker rod tong, such as the BJ Sucker Rod Tong, which can be used for its prior art purposes, while still being improved according to the present invention to break loose and remove damaged or worn couplings that need to be replaced.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. In a sucker rod tong comprising a body having an opening adapted to receive a sucker rod assembly, a rotatable jaw assembly operably engaged in the body at the opening and adapted to engage the sucker rod assembly, a powered mechanism adapted to rotate the jaw assembly, and a lower backup wrench operably positioned below the jaw assembly, wherein the sucker rod assembly includes a sucker rod having a threaded end and a coupling having a threaded inside wall that is threaded onto the threaded end of the sucker rod, and wherein the lower backup wrench is adapted to hold the sucker rod, the improvement comprising:

an elongated shaft removably received in the jaw assembly, the shaft being operably engaged with the jaw assembly so that rotation of the jaw assembly causes the shaft to rotate, the shaft having opposing ends and an extractor on at least one end, wherein the extractor is sized and designed to bite into and engage with the threaded inside wall of the coupling while the shaft is rotated for unscrewing the coupling from the sucker rod, and a radial element that extends radially outwardly with respect to the longitudinal axis of the shaft, wherein the radial element is in a fixed relationship with respect to the shaft such that the radial element rotates about the longitudinal axis of the shaft while the shaft rotates about its longitudinal axis, and wherein the radial element is a driving flange that fits within and engages with the jaw assembly for receiving a rotational force from the jaw assembly and/or is a positioning flange that rests upon and/or engages with the jaw assembly for locating the extractor in a proper position with respect to the threaded inside wall of the coupling.

2. The improved sucker rod tong of claim 1, further comprising a shield having a cylindrical shape surrounding the extractor in a concentric relationship with the extractor, wherein the shield is in a fixed relationship with the shaft.

3. The improved sucker rod tong of claim 1, wherein the radial element is the positioning flange, further comprising a second radial element that extends radially outwardly with respect to the longitudinal axis of the shaft and functions as the driving flange, wherein the second radial element is in a fixed relationship with the shaft.

4. The improved sucker rod tong of claim 1, wherein the radial element is the positioning flange, further comprising:

second and third radial elements that extend radially outwardly with respect to the longitudinal axis of the shaft, wherein each of the second and third radial elements functions as the driving flange, wherein the second and third radial elements are fixed to the shaft;

a second extractor on the other end of the shaft;

a first shield having a cylindrical shape surrounding the extractor in a concentric relationship with the extractor; and a second shield having a cylindrical shape surrounding the second extractor in a concentric relationship with the second extractor, wherein the first and second shields are fixed to the second and third radial elements, respectively.

5. In a sucker rod tong comprising a body having an opening adapted to receive a sucker rod assembly, a rotatable jaw assembly operably engaged in the body at the opening and adapted to engage the sucker rod assembly, a powered mechanism adapted to rotate the jaw assembly and a lower backup wrench operably positioned below the jaw assembly, wherein the sucker rod assembly includes a sucker rod having a threaded end and a coupling having a threaded inside wall that is threaded onto the threaded end of the sucker rod, and wherein the lower backup wrench is adapted to hold the sucker rod, the improvement comprising:

a coupling extractor removably engaged with the jaw assembly such that rotation of the jaw assembly causes the coupling extractor to rotate, the coupling extractor comprising a shaft and a radial projection connected directly or indirectly to the shaft, the shaft having a longitudinal axis and an end adapted as an extractor for engaging the inside wall of the coupling for unscrewing the coupling from the sucker rod, wherein the radial projection extends radially outwardly with respect to the longitudinal axis of the shaft.

6. The improved sucker rod tong of claim 5, wherein the end of the shaft adapted as an extractor is an extractor selected from the group consisting of an easy-out extractor, a pipe nipple extractor, and an internal pipe wrench.

7. The improved sucker rod tong of claim 5, wherein the shaft has an opposing end also adapted as an extractor for engaging the inside wall of a coupling for unscrewing the coupling from a sucker rod, the sucker rod tong being adapted for work on a sucker rod assembly that is oriented vertically in which case the coupling extractor is oriented vertically with an upper extractor end and a lower extractor end, and wherein the upper extractor end is adapted for removing a coupling attached to a lower end of a sucker rod and the lower extractor end is adapted for removing a coupling attached to an upper end of a sucker rod.

8. The improved sucker rod tong of claim 5, wherein each end of the coupling extractor shaft is adapted as an extractor to provide an upper extractor end and a lower extractor end, further comprising an upper backup wrench mounted to the body above an upper surface of the body, the upper backup wrench being adapted to hold an upper sucker rod while the upper extractor end of the coupling extractor engages and rotates a coupling to loosen the coupling from the upper sucker rod.

9. The improved sucker rod tong of claim 5, further comprising a hanger assembly connected to the body of the tong and an upper backup wrench received in the hanger assembly, the upper backup wrench being adapted to hold a sucker rod while the coupling extractor engages and rotates the coupling to loosen the coupling from the sucker rod.

10. The improved sucker rod tong of claim 5, wherein the shaft has an opposing end also adapted as an extractor for engaging the inside wall of a coupling for unscrewing the coupling from a sucker rod, the sucker rod tong being adapted for work on a sucker rod assembly that is oriented vertically in which case the coupling extractor is oriented vertically with an upper extractor end and a lower extractor end, and wherein the upper extractor end is adapted for removing a coupling attached to a lower end of a sucker rod and the lower extractor end is adapted for removing a coupling attached to an upper end of a sucker rod, further comprising a hanger assembly connected to the body of the tong and an upper backup wrench received in or engaged with the hanger assembly, the upper backup wrench being adapted to hold a sucker rod near a bottom end of the rod while the upper extractor end of the coupling extractor engages and rotates a coupling to loosen the coupling from the sucker rod, and the lower backup wrench being adapted to hold a sucker rod near an upper end of the sucker rod while the lower extractor end of the coupling extractor engages and rotates a coupling to loosen the coupling from the sucker rod.

11. The improved sucker rod tong of claim 5, wherein each end of the coupling extractor shaft is adapted as an easy-out extractor to provide an upper extractor end and a lower extractor end, further comprising a hanger assembly connected to the body of the tong and an upper backup wrench received in or engaged with the hanger assembly, the upper backup wrench being adapted to hold a sucker rod.

12. The improved sucker rod tong of claim 11, wherein each easy-out extractor is a tapered, left-handed spiral fluted length.

13. The improved sucker rod tong of claim 5, further comprising a driving flange extending radially from the shaft, wherein the jaw assembly engages the driving flange for rotating the coupling extractor.

14. The improved sucker rod tong of claim 13, further comprising a shield surrounding the end of the shaft adapted as an extractor, wherein the shield is attached to the driving flange and/or to the shaft.

15. The improved sucker rod tong of claim 5, wherein the radial projection is a centering flange for aligning the shaft with respect to the jaw assembly, further comprising a driving flange, wherein the jaw assembly engages the driving flange for rotating the coupling extractor.

16. The improved sucker rod tong of claim 5, wherein the radial projection is a driving flange, wherein the jaw assembly engages the driving flange for rotating the coupling extractor, further comprising a centering flange for aligning the shaft with respect to the jaw assembly.

17. The improved sucker rod tong of claim 5, wherein the radial projection is a centering flange for aligning the shaft with respect to the jaw assembly, further comprising first and second driving flanges fixed to the shaft and spaced apart, wherein the jaw assembly engages one or both of the driving flanges for rotating the coupling extractor.

18. The improved sucker rod tong of claim 17, further comprising a first shield surrounding the first driving flange and a second shield surrounding the second driving flange, wherein the first and second shields are fixed to the first and second driving flanges, respectively.

19. The improved sucker rod tong of claim 18, wherein the centering flange is connected to the first or second shield and extends radially outwardly therefrom.

20. The improved sucker rod tong of claim 19, wherein the centering flange has a pair of opposing tabs extending toward the first driving flange essentially parallel to the longitudinal axis of the shaft.

21. The improved sucker rod tong of claim 5, wherein the radial projection is a centering flange for aligning the shaft with respect to the jaw assembly, and wherein the other end of the shaft is also adapted as an extractor for engaging the inside wall of the coupling for unscrewing the coupling from the sucker rod.

22. In a sucker rod tong comprising a body having an opening adapted to receive a sucker rod assembly, a rotatable jaw assembly operably engaged in the body at the opening and adapted to engage the sucker rod assembly, a powered mechanism adapted to rotate the jaw assembly and a backup wrench operably positioned with respect to the jaw assembly, wherein the sucker rod assembly includes a sucker rod having a threaded end and a coupling having a threaded inside wall that is threaded onto the threaded end of the sucker rod, and wherein the backup wrench is adapted to hold the sucker rod, the improvement comprising:

a coupling extractor removably engaged with the jaw assembly, the coupling extractor having a coupling engaging member adapted to engage the inside wall of the coupling and a jaw assembly engaging member adapted to engage and/or rest upon the jaw assembly, the jaw assembly engaging member extending radially outwardly with respect to the longitudinal axis of the of the sucker rod assembly, wherein the coupling extractor is adapted for rotation by the jaw assembly thereby providing rotation of the coupling engaging member, and wherein the sucker rod tong and the coupling extractor are adapted to operate in a manner whereby the backup wrench holds the sucker rod while the coupling extractor unscrews the coupling from the sucker rod.

23. The improved sucker rod tong of claim 22, wherein the coupling engaging member is selected from the group comprising an easy-out extractor, a pipe nipple extractor and an internal pipe wrench.

24. The improved sucker rod tong of claim 22, wherein the coupling extractor comprises a shaft having an easy-out extractor on each end, further comprising a hanger assembly and a second backup wrench moveably engaged with the hanger assembly.

25. The improved sucker rod tong of claim 24, further comprising an enclosure that surrounds the easy-out extractor on each end of the shaft for retaining shards from the coupling in the event that the coupling breaks.

26. The improved sucker rod tong of claim 25, further comprising an enclosure that surrounds the easy-out extractor on each end of the shaft for retaining shards from the coupling in the event that the coupling breaks.

* * * * *